US005975600A

United States Patent [19]

Hwang

[11] Patent Number: 5,975,600

[45] Date of Patent: Nov. 2, 1999

[54] GOLF BALL RETRIEVING AND DISPENSING DEVICE

[76] Inventor: Kee Y. Hwang, 5255 Stevens Creek Blvd. #300, Santa Clara, Calif. 95051

[21] Appl. No.: 09/100,641

[22] Filed: Jun. 19, 1998

[51] Int. Cl.[6] ..... A63B 47/02

[52] U.S. Cl. ..... 294/19.2; 221/199; 221/301

[58] Field of Search ..... 294/19.1, 19.2, 294/22, 99.1, 100; 206/315.9; 221/185, 194, 199, 289, 298, 282, 301, 303, 304, 306, 310; 473/286, 386, 517

[56] References Cited

U.S. PATENT DOCUMENTS

| | | | |
|---|---|---|---|
| 2,962,321 | 11/1960 | Fowler et al. | 294/19.2 |
| 3,281,013 | 10/1966 | Motard | 294/19.2 X |
| 3,344,955 | 10/1967 | Ingham | 294/19.2 X |
| 4,058,336 | 11/1977 | Parkinson | 294/19.2 |
| 4,676,397 | 6/1987 | Hoffmeister | 294/19.2 X |
| 4,781,307 | 11/1988 | Ferro | 221/301 X |
| 5,147,101 | 9/1992 | Tiller | 294/19.2 |

*Primary Examiner*—Johnny D Cherry
*Attorney, Agent, or Firm*—The Kline Law Firm

[57] ABSTRACT

A tubular golf ball retrieving and dispensing device that includes a tubular main body for storage of the retrieved balls with an open retrieving/dispensing end. A one-way detent obstructs the retrieving/dispensing end so that balls may be forced past the detent into the storage tube, but the balls will not exit the tube past the detent until a release mechanism retracts the detent. A handle at the distal end of the storage tube includes a triggering device for the release mechanism.

7 Claims, 4 Drawing Sheets

GOLF BALL RETRIEVING AND DISPENSING DEVICE

FIELD OF THE INVENTION

The present invention relates generally to golf ball retrieval devices, and more particularly is a straight tube retrieval device that is also capable of dispensing the retrieved balls one at a time.

BACKGROUND OF THE INVENTION

Golf is a sport that, to be played well, demands a significant amount of practice. Practice for golf can only be had by performing as many stroke repetitions as possible to create the muscle memory to reproduce an effective swing or putt. The problem is that to strike a large number of balls, the player must either collect all the balls hit, or pay for someone else to do it. The latter method, i.e. buying a bucket of balls at a driving range, is quite often the method of choice, but can become quite expensive.

Therefore, many players use a "shag bag" or similar device that contains a significant number of practice balls. The player takes his bag and club(s) to the practice area, and drops some or all of the balls on the ground. The player then hits the balls toward a target for his practice session. The problem arises in that the balls must then be retrieved.

The prior art discloses many devices that utilize a tubular element in which to collect balls. Typically, these devices are constructed with a restricting means in a first end. The golf balls are forced past the restricting means and into the tube storage area. The tube is then inverted to release balls from the other end of the tube. Some examples of this type of prior art device are the "Apparatus for Retrieving Disbursed Objects" by Duncan, U.S. Pat. No. 5,505,510, issued Apr. 10, 1996; the "Ball Retrieving and Storage Device" by Hockey, U.S. Pat. No. 5,466,027, issued Nov. 14, 1995; "Devices for Picking Up Balls" by Parkinson, U.S. Pat. No. 4,058,336, issued Nov. 15, 1977; and the "Deformable Ball Retrieving, Retaining, and Dispensing Device" by Summers, U.S. Pat. No. 5,188,410, issued Feb. 23, 1993.

One problem with these straight tube devices is that the tube must be inverted to dispense the balls. With a storage tube of any size, this can be an awkward and unwieldy operation.

One prior art device addresses this drawback by installing a releasable detent in an open end of the tube. The "Golf Ball Dispensing and Retrieving System" of Tiller, U.S. Pat. No. 5,147,101, issued Sep. 15, 1992, discloses a tubular device with a detent mechanism that is pushed aside to allow the ball to enter the tube, and then is released by a triggering mechanism when the user wishes to use the balls for practice. One limitation to the Tiller device is that it envisions placing the tube in a stationary position and operating the release mechanism with either a user's hand or the golf club.

Accordingly, it is an object of the present invention to provide a tubular golf ball retrieving and dispensing device that includes a release means that allows the user to dispense balls from the same end of the tube in which the balls are collected.

It is a further object of the present invention to provide a device that allows the user to move about while dispensing balls so that the balls are not dispensed in a single location.

It is a still further object of the present invention to provide a convenient handle means at an end of the tube distal from the ball retrieving/dispensing end.

SUMMARY OF THE INVENTION

The present invention is a tubular golf ball retrieving and dispensing device. The device includes a tubular main body for storage of the retrieved balls with an open retrieving/dispensing end. A releasable detent obstructs the retrieving/dispensing end so that balls may be forced past the detent into the storage tube, but the balls will not exit the tube past the detent until a release mechanism retracts the detent. A handle at the distal end of the storage tube includes a triggering device for the release mechanism.

An advantage of the present invention is that it enables the user to retrieve balls without bending over to pick up the balls.

Another advantage of the present invention is that it allows the user to dispense the balls either one at a time or as many at a time as is desired.

A still further advantage of the present invention is that the retrieving/dispensing end of the tube is angled to provide easier pickup.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

The present invention is a tubular golf ball retrieving and dispensing device 10. The device includes a tubular main body 12 for storage of the retrieved balls. A first end of the tubular main body 12 is open to form a retrieving/dispensing end 14. The retrieving/dispensing end 14 is angled slightly so that if the device 10 is placed on a flat surface, the main body 12 would be angled slightly toward the rear at an angle 5–10° from perpendicular.

Figure 3:
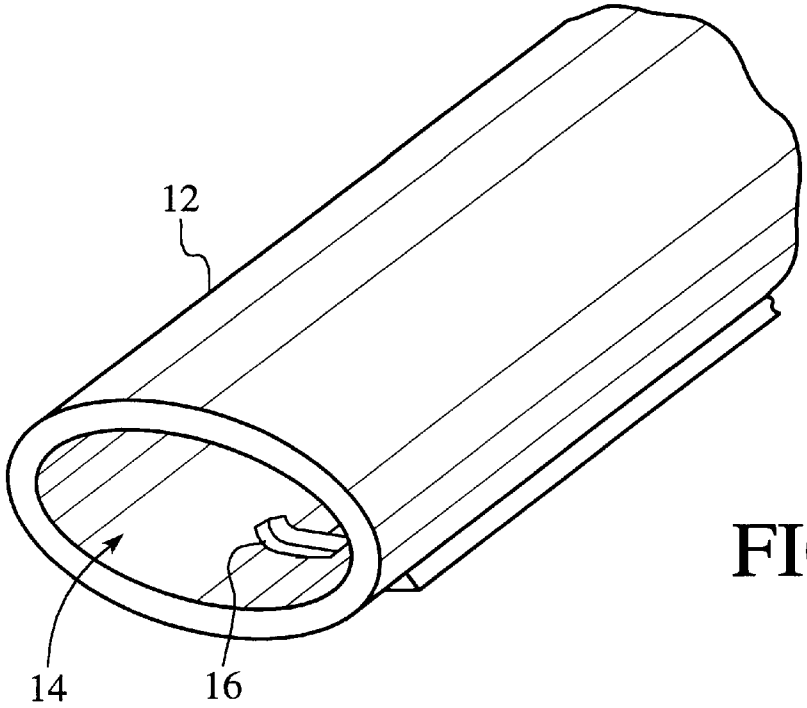
FIG. 3 shows the retrieving/dispensing end of the device.
Figure 4:
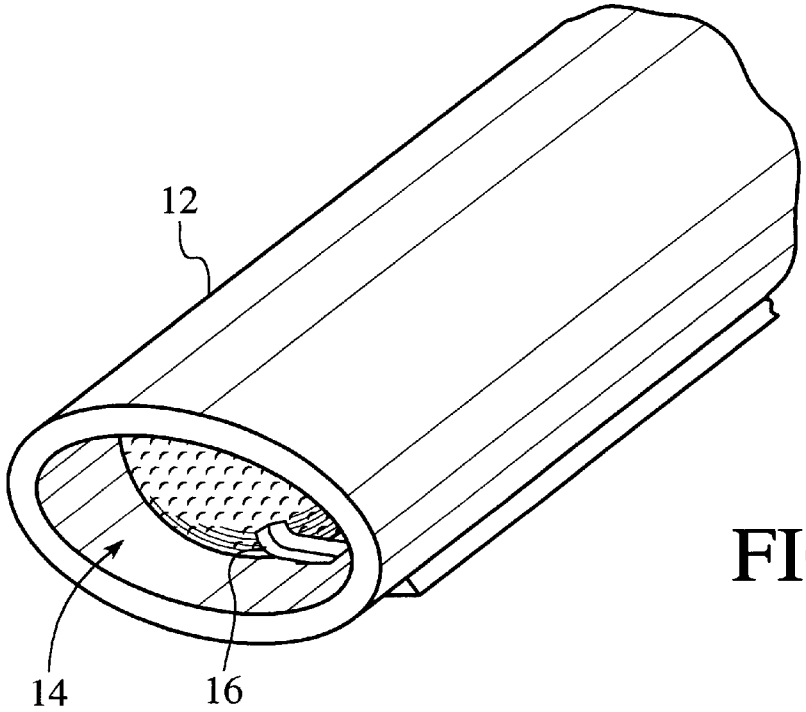
FIG. 4 shows the retrieving/dispensing end of the device with a golf ball retained against the detent.

The retrieving/dispensing end 14 of the device 10 is partially obstructed by a releasable detent 16, as shown in FIGS. 3 and 4. The detent 16 extends slightly into the central cavity of the main body 12 near the retrieving/dispensing end 14, and is slightly angled toward the retrieving/dispensing end 14. The free end of the detent is upturned. This allows the detent 16 to be easily pulled from the central cavity of the main body 12 by a release mechanism. When the user places the retrieving/dispensing end 14 over the balls and presses downward, or activates the release mechanism, the detent 16 is retracted from the central cavity so that the balls can freely pass by the detent 16 into and out of the central cavity of the main body 12.

Figure 1:
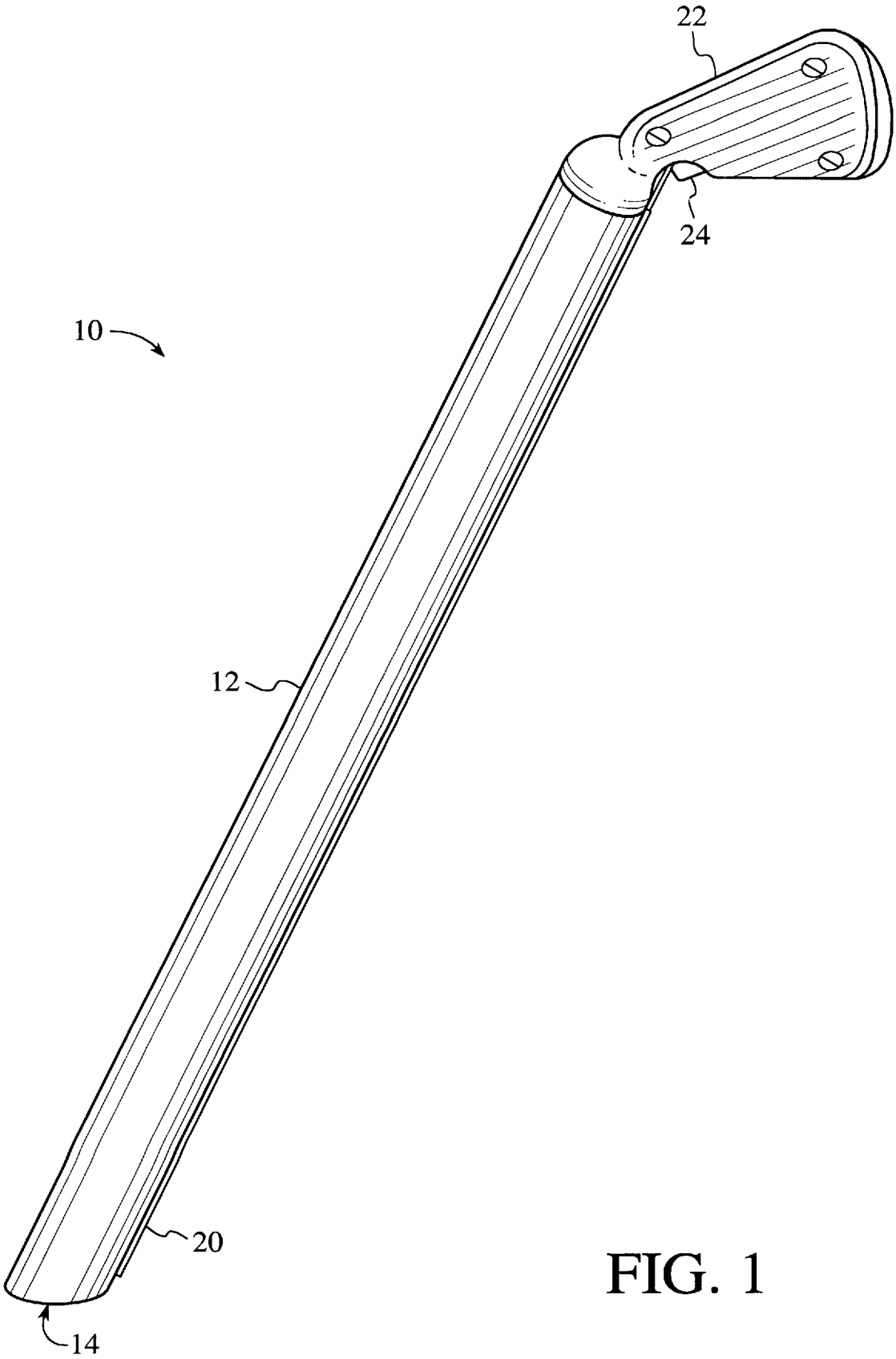
FIG. 1 is a perspective view of the golf ball retrieving and dispensing device of the present invention.
Figure 2:
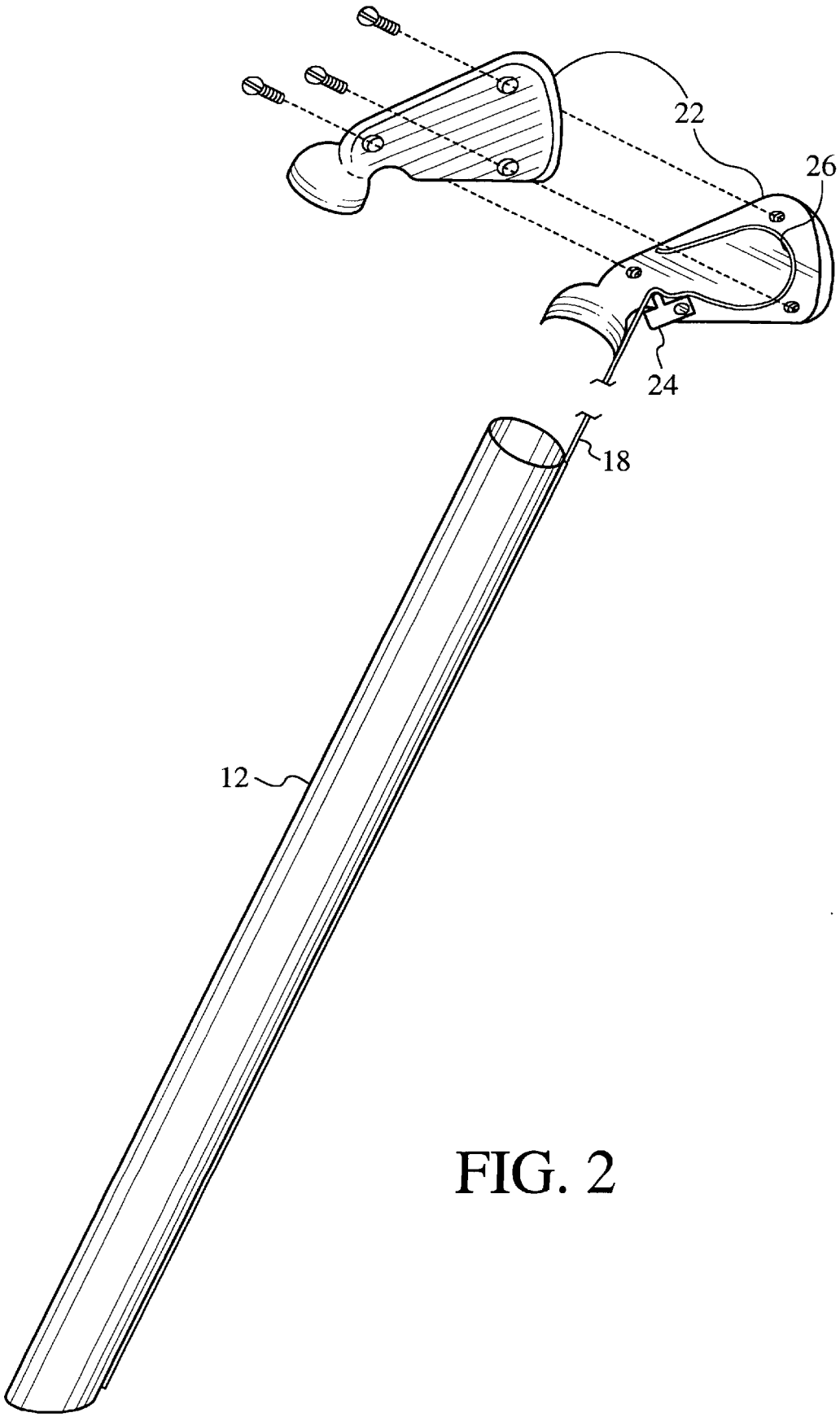
FIG. 2 is an exploded perspective view of the device.

The release mechanism of the device 10 is shown in detail in FIG. 2. The release mechanism shaft 18 is in communication with the detent 16. The release shaft 18 passes through a release shaft housing 20 on the rear side of the main body 12, and into a handle 22 at a top end of the main body 12. The release shaft 18 connects with a triggering device 24 contained in the handle 22 by means of an upper end loop 26.

Figure 5:
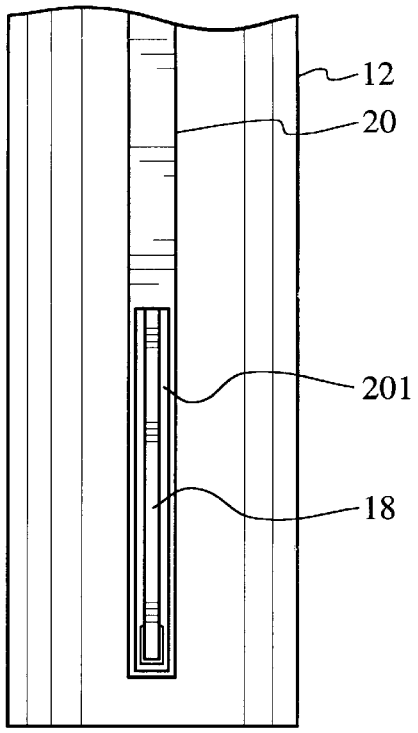
FIG. 5 is a rear view of the main body showing the shaft opening.
Figure 6A:
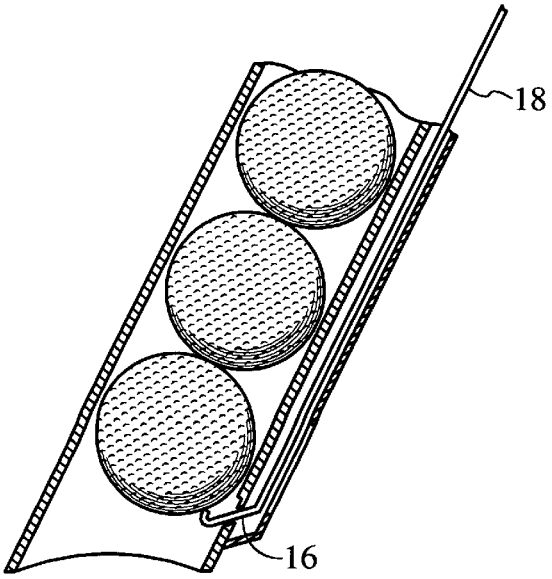
FIG. 6A is a cross section of the lower end of the device showing several balls retained by the detent.
Figure 6B:
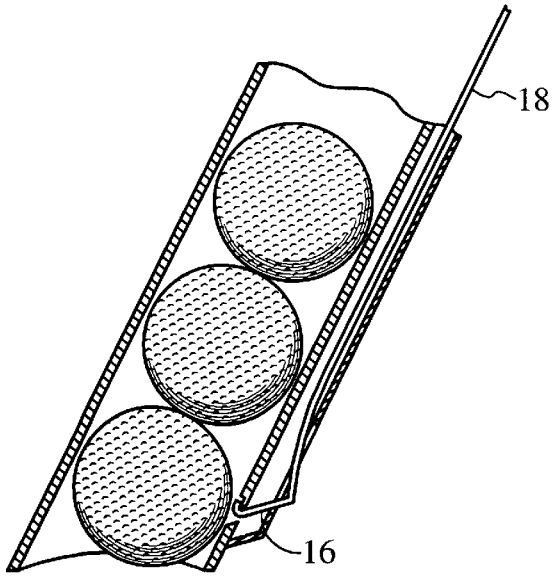
FIG. 6B is a cross section of the lower end of the device showing the detent released by the release shaft.

In the preferred embodiment, the detent 16, the release shaft 18, and the upper end loop 26 are a single integral component. The release shaft 18 is sufficiently rigid so that the shaft 18 does not stretch when pulled upward by the triggering device 24. However, the upper end loop 26 is sufficiently flexible to be bent into a loop in the handle 22. The release shaft housing 20 must provide sufficient clearance so that the detent 16 moves out of the mouth of the retrieving/dispensing end 14 when the release mechanism is activated. This is most easily achieved by including a release shaft opening 201 in the shaft housing 20 (see FIG. 5). The shaft opening 201 allows the detent 16 and the lower end of the release mechanism shaft 18 to protrude outward from the shaft housing 20 (see FIG. 6B) when the triggering device 24 is activated.

To collect golf balls with the golf ball retriever/dispenser 10, the user holds the device by the handle 22. He places the retrieving/dispensing end 12 over the ball to be picked up, and presses downward. The ball is forced past the detent 16 and into a central cavity of the main body 12 which serves as a storage area. This process is repeated until all the balls are collected, or until the main body 12 is full.

To release one or more golf balls, the user depresses the triggering device 24. This action compresses the upper end loop 26, and raises the release shaft 18. The detent 16 is pulled out of the retrieving/dispensing end 14 to allows balls to pass out of the retrieving/dispensing end 14. The user keeps the triggering device 24 depressed until as many balls as he desires to use fall out of the main body 12. Because of the location of the triggering device 24 in the handle 22 of the dispenser 10, a user can easily operate the device with one hand.

It should be recognized that the retriever/dispenser can be used with other balls apart from golf balls. It is envisioned that the device will also be constructed in sizes to accommodate tennis balls and baseballs as well as golf balls.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A ball retrieving and dispensing device comprising:

a tubular main body that includes a central cavity adapted to store retrieved balls, a first end of said main body is open, a plane of said first end is not perpendicular to a longitudinal axis of said main body, a releasable detent that partially obstructs said first end of said main body, a release mechanism that removes said detent from said first end of said main body, and a triggering device that activates said release mechanism, said triggering device is contained in a handle of said device, said handle is located at an end of said main body distal to said first end; wherein said detent is removed from said first end of said main body to allow the retrieved balls to enter said central cavity by applying pressure by placing said device over a ball and pressing downward, the ball contacting said detent, and said detent is removed from said first end of said main body to allow the retrieved balls to be dispensed by activating said release mechanism via said triggering device, said triggering device is in communication with a release mechanism shaft which is in turn in communication with said detent.

2. The ball retrieving and dispensing device of claim 1 wherein:

said plane of said first end of said main body is at an angle 5–10° from perpendicular to said longitudinal axis of said main body.

3. The ball retrieving and dispensing device of claim 1 wherein:

said detent is integral to said release mechanism shaft.

4. The ball retrieving and dispensing device of claim 1 wherein:

said release mechanism is activated by said triggering device compressing an upper end loop of said release mechanism shaft in said handle so that said release mechanism shaft is pulled upward, thereby removing said detent from said first end of said main body.

5. The ball retrieving and dispensing device of claim 1 wherein:

said main body includes a housing for said release mechanism shaft.

6. A ball retrieving and dispensing device comprising:

a tubular main body that includes a central cavity adapted to store retrieved balls, a first end of said main body is open, a releasable detent that partially obstructs said first end of said main body, said detent is integral to a release mechanism that removes said detent from said first end of said main body, and a triggering device that activates said release mechanism, said triggering device is contained in a handle of said device, said handle is located at an end of said main body distal to said first end; wherein said detent is removed from said first end of said main body to allow said retrieved balls to enter said central cavity by applying pressure by placing said device over a ball and pressing downward, the ball contacting said detent, and said detent is removed from said first end of said main body to allow the retrieved balls to be dispensed by activating said release mechanism via said triggering device, said triggering device compresses an upper end loop of a release mechanism shaft in said handle so that said release mechanism shaft is pulled upward, thereby removing said detent from said first end of said main body.

7. The ball retrieving and dispensing device of claim 6 wherein:

said main body includes a housing for said release mechanism shaft.

* * * * *